US005818002A

United States Patent [19]

Kurtz et al.

[11] Patent Number: 5,818,002

[45] Date of Patent: Oct. 6, 1998

[54] PRESSURE CHANGE WARNING SWITCH

[75] Inventors: Kevin D. Kurtz, Ft. Wayne; Steven N. Ginn, Granger; David L. Kordecki, Elkhart, all of Ind.

[73] Assignee: CTS Corporation, Elkhart, Ind.

[21] Appl. No.: 810,500

[22] Filed: Feb. 28, 1997

Related U.S. Application Data

[60] Provisional application No. 60/012,668 Mar. 1, 1996.

[51] Int. Cl. [6] ..... H01H 35/34

[52] U.S. Cl. ..... 200/834; 200/83 N

[58] Field of Search ..... 91/1; 92/103 M; 340/605, 626, 940; 361/283.4; 307/118; 73/716, 717, 723; 200/83 R, 83 B, 83 AS, 83 SA, 83 W, 83 N, 83 Y, 61.25, 81.5

[56] References Cited

U.S. PATENT DOCUMENTS

| | | | |
|---|---|---|---|
| 2,650,965 | 9/1953 | Morrison . | |
| 2,932,972 | 4/1960 | Cosby et al. . | |
| 3,093,806 | 6/1963 | Gutterman . | |
| 3,743,801 | 7/1973 | Brobeck | 200/61.25 |
| 3,808,480 | 4/1974 | Johnston | 317/256 |
| 4,151,578 | 4/1979 | Bell . | |
| 4,160,139 | 7/1979 | Johnston . | |
| 4,177,496 | 12/1979 | Bell et al. . | |
| 4,184,189 | 1/1980 | Davis et al. . | |
| 4,207,604 | 6/1980 | Bell . | |
| 4,211,901 | 7/1980 | Matsuda et al. . | |
| 4,211,935 | 7/1980 | Erben . | |
| 4,307,272 | 12/1981 | Dvorachek . | |
| 4,329,732 | 5/1982 | Kavli et al. . | |
| 4,386,247 | 5/1983 | Covat | 200/61.25 |
| 4,388,668 | 6/1983 | Bell et al. . | |
| 4,426,673 | 1/1984 | Bell et al. . | |
| 4,879,627 | 11/1989 | Grantham . | |
| 4,898,699 | 2/1990 | Hofmann | 264/43 |
| 4,974,117 | 11/1990 | Irwin . | |
| 5,020,377 | 6/1991 | Park . | |
| 5,163,327 | 11/1992 | Papai . | |
| 5,194,219 | 3/1993 | Baldi | 419/37 |
| 5,225,643 | 7/1993 | Marchant | 200/83 N |

FOREIGN PATENT DOCUMENTS

| | | | |
|---|---|---|---|
| 916054 | 11/1946 | France | 200/83 N |
| 1391698 | 3/1972 | United Kingdom | 200/83 N |

*Primary Examiner*—Gerald P. Tolin

*Attorney, Agent, or Firm*—Michael W. Starkweather; Dan Tychonievich

[57] ABSTRACT

A pressure switch is illustrated that includes only three piece parts—two dimpled covers and a spacer. By selecting both the type and thickness of cover materials, switching pressure ranges can be selected to accommodate a very wide range of operating pressures. Fine adjustment of the switching pressure may be made by modifying the cover dimples. Reliability and a hermetic seal is attained through the use of appropriate materials for the covers and spacer, together with active metal braze seals which provide high temperature, moisture and chemical resistance. A vacuum port is added for providing the ability to modify the air pressure within the pressure switch.

13 Claims, 4 Drawing Sheets

PRESSURE CHANGE WARNING SWITCH

CROSS REFERENCE TO RELATED APPLICATIONS

This application is a continuation of application Ser. No. 60/012,668 filed on Mar. 1, 1996.

BACKGROUND OF THE INVENTION

1. Field of the Invention

This invention pertains generally to pressure switches, and specifically to pressure switches adapted for application in a rugged sensing environment such as in vehicle tires.

2. Description of the Related Art

Many applications exist, where a reliable and inexpensive pressure switch is needed. One obvious application is as a part of a system to warn about low pressure in vehicle tires. As tire failures are sometimes the result of under-inflation, the application of pressure switches to automotive or land vehicle tires has been proposed for many years. By incorporating a tire pressure switch into the hub of the tire, a warning system may alert the vehicle operator to under-inflation prior to the tire being damaged.

In addition, new tires have been developed to operate at zero pressure for brief distances, to allow a vehicle operator to drive the vehicle to a service station. Unfortunately, these new tires sometimes perform so well that the vehicle operator is unaware of the zero pressure condition. In those instances, the operator may continue to operate the vehicle, eventually resulting in failure of the tire.

In spite of benefit available to vehicle operators, actual production of tire pressure switches has been hindered. Within a tire the environment is very harsh. The switches must survive high vibration, extreme acceleration forces, extreme over-pressure forces, elevated temperatures, potential exposure to moisture and steam, and potential exposure to chemical compounds such as tire sealants and solvents. Heretofore, no cost effective and reliable switches were available that were capable of surviving the harsh environment.

One type of previously proposed pressure switch was made from micro-machined silicon. However, silicon micro-machined switches require most components to form electrical interconnection and packaging. Additionally, silicon switches do not provide intrinsic compensation for over-pressure. As a result, silicon switches may potentially fail when a tire is over-inflated.

Another type of tire pressure switch is a single diaphragm switch resembling a metal can with a flexible bellows mounted on top. The diaphragm type switch uses a convoluted diaphragm that is non-linear, making design and calibration of the switch difficult. In addition, the single diaphragm is very sensitive to forces normal to the diaphragm surface, such as might occur during travel on a rough or uneven roadway.

Some previously proposed switches use one of the electrode pins to introduce a controlled pressure reference gas into a sealed chamber within the switch. These designs tend to be very sensitive to temperature variations, as the gas must change volume or pressure in accordance with temperature.

There is also known in the prior art a variety of pressure transducers used to measure pressure either by resistive or capacitive means. The present invention is a simpler way of providing an on-off switching mechanism when the pressure reaches the designed switching level.

3. Related Art

Examples of patents related to the present invention are as follows, and each patent is herein incorporated by reference for the supporting teachings:

U.S. Pat. No. 2,650,965 is a vacuum controlled auxiliary ignition switch for internal combustion engines.

U.S. Pat. No. 2,932,972 is a pressure-responsive electrical transducer incorporating means for canceling effects of vibration, gravity and acceleration stresses.

U.S. Pat. No. 3,093,806 is a pressure transducer.

U.S. Pat. No. 4,151,578 is a capacitive pressure transducer.

U.S. Pat. No. 4,160,139 is a pressure sensitive switch.

U.S. Pat. No. 4,177,496 is a capacitive pressure transducer.

U.S. Pat. No. 4,184,189 is a capacitive pressure sensor and a method of making it.

U.S. Pat. No. 4,207,604 is a capacitive pressure transducer with a cut conductive plate.

U.S. Pat. No. 4,211,901 is a pressure sensing switch with a conductive deflectable diaphragm.

U.S. Pat. No. 4,211,935 is an electronic pressure switch.

U.S. Pat. No. 4,307,272 is a pressure actuated switch.

U.S. Pat. No. 4,329,732 is a precision capacitance transducer.

U.S. Pat. No. 4,388,668 is a capacitive pressure transducer.

U.S. Pat. No. 4,426,673 is a capacitive pressure transducer and method of making the same.

U.S. Pat. No. 4,879,627 is a differential capacitive pressure sensor with over pressure protection.

U.S. Pat. No. 4,974,117 is a dual diaphragm capacitive differential pressure transducer.

U.S. Pat. No. 5,020,377 is a low pressure transducer using metal foil diaphragm.

U.S. Pat. No. 5,163,327 is a pressure sensing element.

The foregoing patents reflect the state of the art of which the applicant is aware and are tendered with the view toward discharging applicants' acknowledged duty of candor in disclosing information which may be pertinent in the examination of this application. It is respectfully stipulated, however, that none of these patents teach or render obvious, singly or when considered in combination, applicants' claimed invention.

SUMMARY OF THE INVENTION

It is a feature of the preferred embodiment to provide a pressure switch that comprises two covers and a spacer. In one embodiment, active metal braze forms seals between the covers and spacer. Alternatively, solder or sealing glass may form the seals. A first embodiment comprises rounded diaphragms stamped from metal. The diaphragms are electrically separated by a ceramic spacer. The diaphragms include integral electrical terminals and may include dimples to provide better point contact. A second embodiment comprises square diaphragms and a vacuum port eyelet for evacuation and back filling.

The present invention overcomes the limitations of the prior art with a cost-effective construction and can be operated through a relatively unlimited temperature range, and with nearly unlimited environmental resistance. Furthermore the invention provides integral over-pressure protection without adding components and is intrinsically insensitive to acceleration forces.

The invention resides not in any one of these features per se, but rather in the particular combination of all of them herein disclosed and claimed. Those skilled in the art will appreciate that the conception, upon which this disclosure is based, may readily be used as a basis for the designing of other structures, methods and systems for carrying out the several purposes of the present invention. Further, the abstract is neither intended to define the invention of the application, which is measured by the claims, neither is it intended to be limiting as to the scope of the invention in any way.

BRIEF DESCRIPTION OF THE DRAWINGS

These and other objects and features of the invention are achieved in the preferred embodiments with reference to the accompanying drawings, in which.

Figure 1:
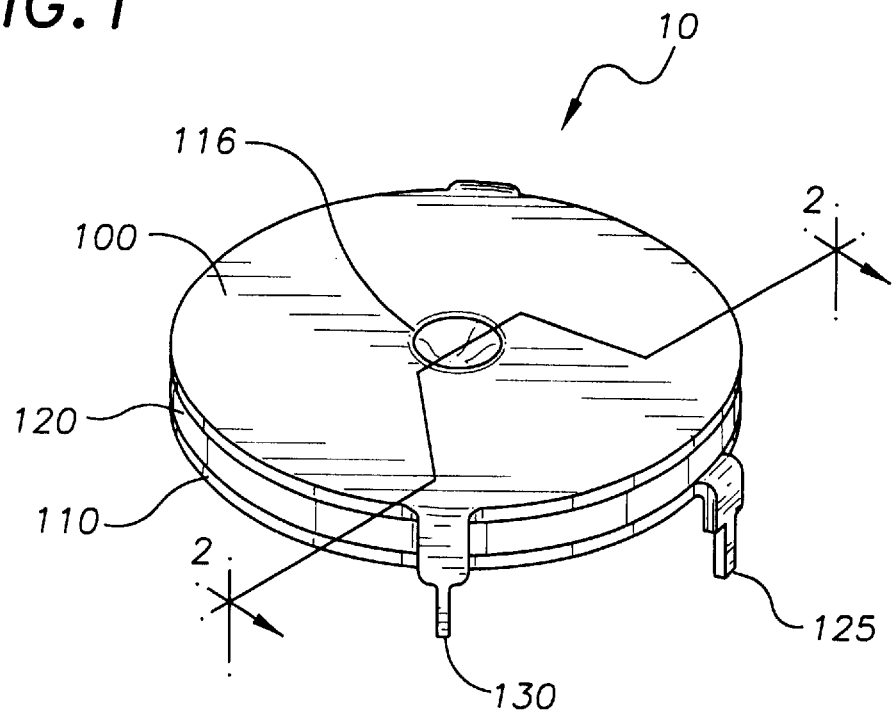
FIG. 1 illustrates a first preferred embodiment of the invention in a projected view.

It is noted that the drawings of the invention are not to scale. The drawings are merely schematic representations, not intended to portray specific parameters of the invention. The drawings are intended to depict only typical embodiments of the invention, and therefore should not be considered as limiting the scope of the invention. In the drawings like numbering represents like elements between the drawings.

DESCRIPTION OF THE PREFERRED EMBODIMENT

Figure 2:
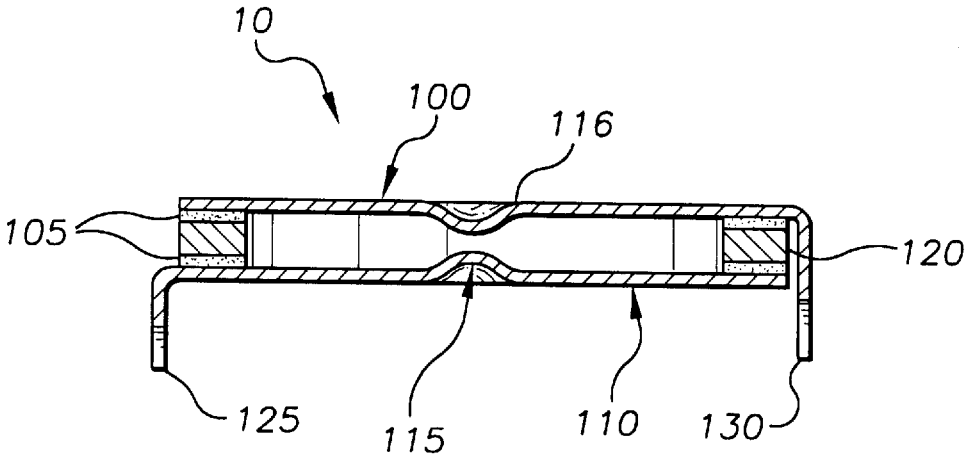
FIG. 2 is a cross sectional view of FIG. 1 taken along section line 2.
Figure 3:
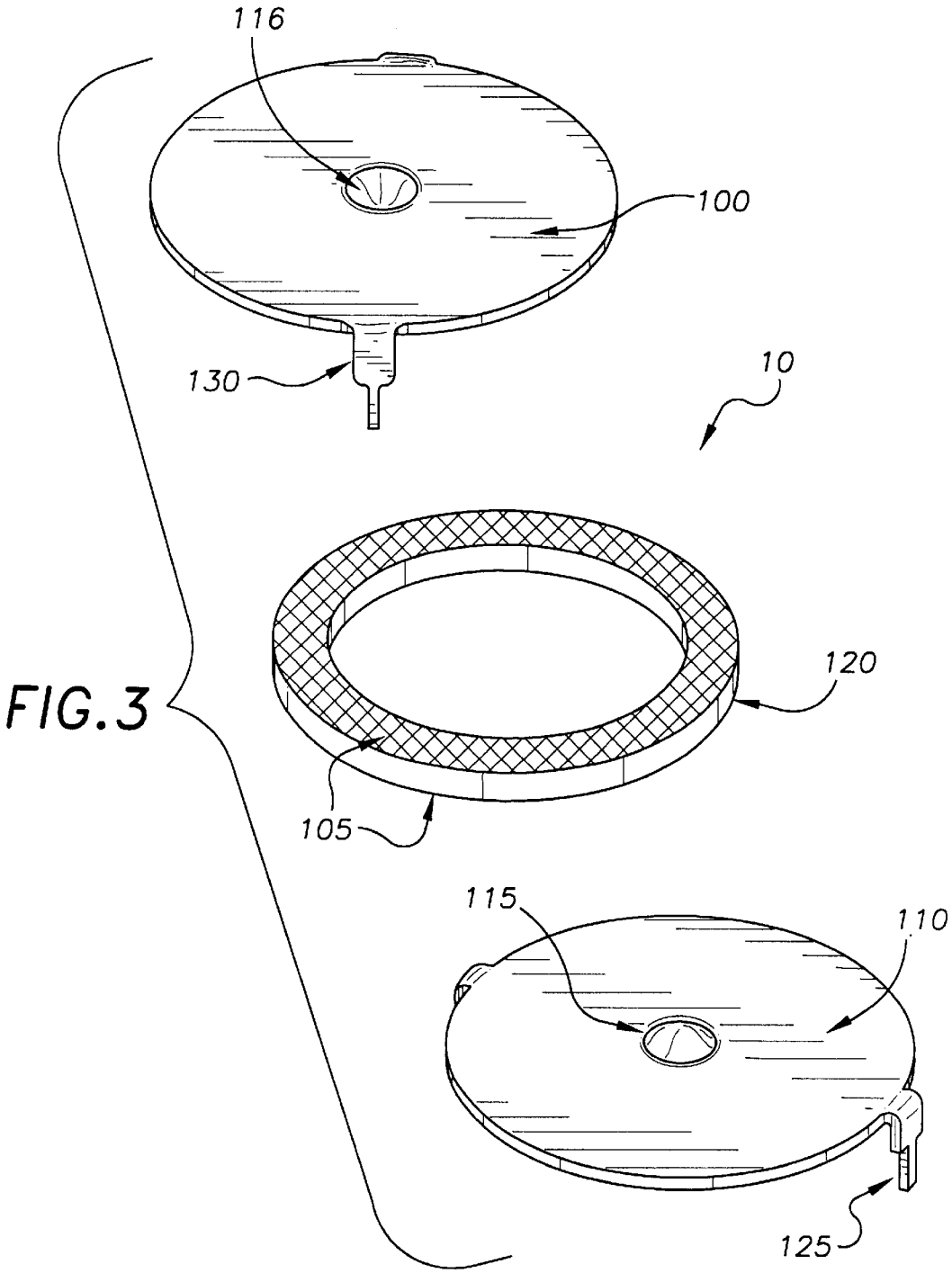
FIG. 3 is an exploded view of the pressure switch in FIG. 1.

Referring to FIGS. 1–3, tire pressure switch 10 illustrates a first preferred embodiment of the invention. Tire pressure switch 10 has an upper diaphragm 100 with a contact dimple 116 generally centered within upper diaphragm 100. Upper diaphragm 100 may preferably be stamped from a stainless steel alloy such as 302 stainless, or may be formed from other suitable material to meet the requirements of the particular application. In tire applications, diaphragm 100 will preferably be both corrosion and temperature resistant. The uses of corrosion resistant iron alloy permits stamping diaphragm 100, which is a preferred method of forming.

Protruding from the generally round outer periphery of upper diaphragm 100 is electrical terminal 130, which may be formed integrally with diaphragm 100. To improve electrical conductivity, diaphragm 100 may be fully or selectively plated with nickel and gold. Most preferably, particularly in view of the cost of gold, dimple 116 will be spot plated with a thin layer of gold on the convex surface.

A lower diaphragm 110 includes electrical terminal 125 and contact dimple 115. Lower diaphragm 110 will preferably be manufactured from the same material as upper diaphragm 100 and with similar manufacturing steps, though there is no requirement that like materials and methods be used. The use of similar steps and methods will generally lower production costs.

Contact dimple 115 is spaced from and generally opposes contact terminal 116, and will also preferably be plated on the convex surface. By plating dimples 115 and 116 selectively with gold, contact resistance is minimized when, as will be described below, dimples 115 and 116 are mechanically pressed together to close the switch.

Electrical and mechanical separation between upper diaphragm 100 and lower diaphragm 110 is achieved with spacer 120. Preferably, spacer 120 is formed from a ceramic material, though any other appropriate electrically non-conductive material may be selected. The choice of a ceramic material ensures long term hermetic sealing and provides intrinsic corrosion and temperature resistance.

Spacer 120 is most preferably attached to diaphragms 100 and 110 with active metal braze 105. Active metal braze 105 is a braze composed of a filler metal such as silver, copper or nickel which is activated with small amounts of titanium, zirconium or hafnium. The activating metal serves to flux or wet both diaphragms 100 and 110, and spacer 120. Even where diaphragms 100, 110 and spacer 120 are of very different composition and are otherwise incompatible, such as where metal diaphragms 100 and 110 are used with ceramic spacer 120, active metal braze 105 may be used to form a hermetic bond. In addition, active metal braze 105 forms a thin but impervious oxide compound on the outer periphery that is highly resistant to corrosion. The use of active metal as a flux is particularly advantageous, since typical metal bonding fluxes form corrosive compounds during bonding. The corrosive compounds are very difficult to totally remove, and will often form the site of future corrosion. As noted, the active metal flux instead contributes significantly to the corrosion resistance of the device, by forming an impervious oxide film on the exterior of the bond. The corrosion resistance of the present invention offers a significant advantage over the prior art.

The assembly and bonding of diaphragms 100, 110 to spacer 120 will most preferably be accomplished in a vacuum kiln. Active metal braze 105 is highly sensitive to oxygen or other reactive compounds when heated, and so must be excluded therefrom until after the bonding is complete. The vacuum bonding operation provides a synergistic advantage, by providing switch 10 with an internal reference pressure that is that of a vacuum.

The thermal coefficient of expansion of spacer 120 will most preferably be matched or similar to the thermal coefficient of expansion of diaphragms 100 and 110. Thermal matching is desirable because active metal brazing occurs at very elevated temperatures, typically about 600–800 degrees Centigrade. After bonding, during cooling of the switch 10 back to room temperature, mismatches in thermal coefficient will result in development of internal stresses within the switch that are undesirable.

As an alternative to active metal braze, either sealing glass or solder may be used to form the seals between diaphragms 100, 110 and spacer 120. The art of sealing using either sealing glass or solder is well developed, and the methodologies required to form a seal will be apparent to those skilled in the art.

In operation of switch 10, switching occurs when upper diaphragm 100 and lower diaphragm 110 each are deformed toward the other sufficiently to cause contact dimples 115 and 116 to contact each other. Fine adjustment of switching pressure may be made by adjusting the size and shape of contact dimples 115 and 116. Coarse adjustment to switching pressure will generally be made by selection of size, shape, thickness and material of diaphragms 100 and 110.

The vacuum formed within switch 10 is desirable, since switching occurs when the pressure exterior to switch 10 is great enough to overcome the mechanical rigidity of the two diaphragms and thereby force contact dimples 115 and 116 into contact. Switch 10 is relatively insensitive to ambient temperature, since there is no trapped reference gas that would otherwise change pressure with temperature.

Switch 10 is also insensitive to acceleration forces that are normal to the surfaces of diaphragms 100 and 110. An acceleration force that might deform diaphragm 100 towards spacer 120 and diaphragm 110 will likewise deform diaphragm 110 away therefrom, resulting in very little change in overall pressure required for activation.

As is immediately apparent, switch 10 further provides resistance to over-pressure. When a pressure external to switch 10 is applied which is significantly beyond the pressure required to bring contact dimples 115 and 116 into contact, more of the surfaces of diaphragms 100 and 110 will be pressed together. Total force applied to each diaphragm is calculated based upon force per unit area. As diaphragms 100 and 110 press together, more of the surface area of each diaphragm is removed from the total surface area to which a force is being applied, because, where diaphragms 100 and 110 touch, the forces applied to each are opposed by the forces applied to the other. Only the surface area that is not in contact with the opposite diaphragm will be unopposed. Further, once contact between dimples 115 and 116 is achieved, the beam arm length represented by the distance between non-supported points on each diaphragm is reduced. This aids in reducing the yield-stress imparted to the diaphragm.

In practice then, the only way for switch 10 to fail during over-pressure is for a diaphragm such as diaphragm 100 to be deformed so tightly around spacer 120 to either internally fail, or to separate from spacer 120 through failure of active braze 105 or internal failure of spacer 120. Active braze 105 is generally stronger than ceramic spacer 120. Ceramic spacer 120 will be placed primarily in compression during over-pressure, and ceramics are extremely strong when in compression. As is apparent, switch 10 is extremely resistant to failure by over-pressure and may withstand forces many times greater than the switching threshold.

Figure 4:
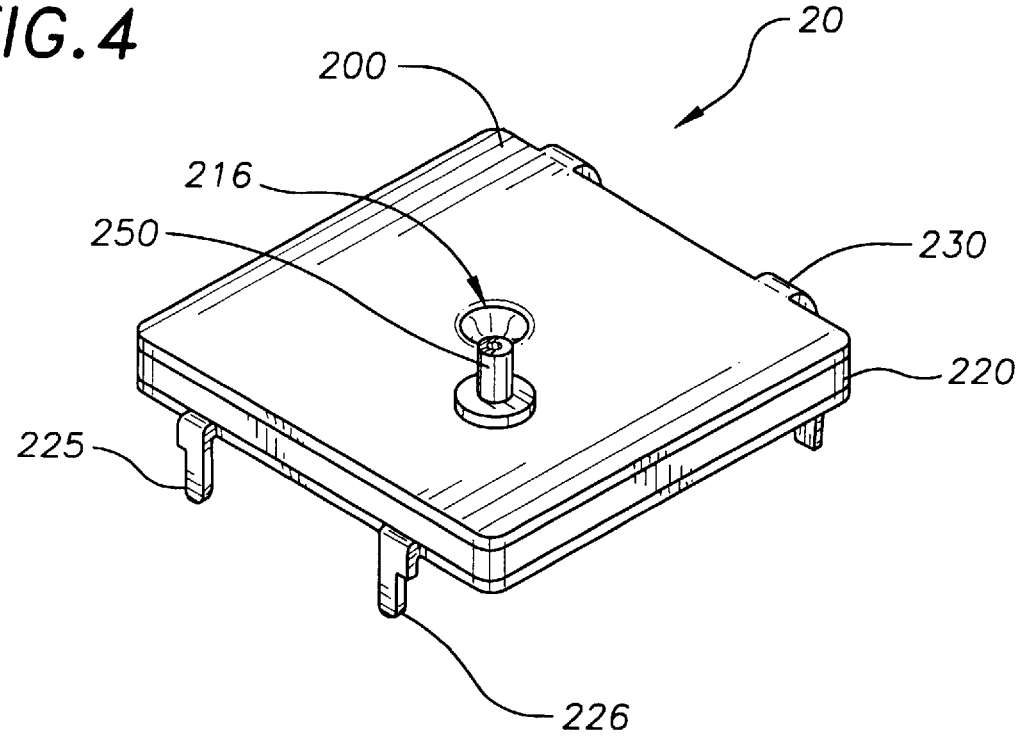
FIG. 4 illustrates a second preferred embodiment of the invention by projected view.
Figure 6:
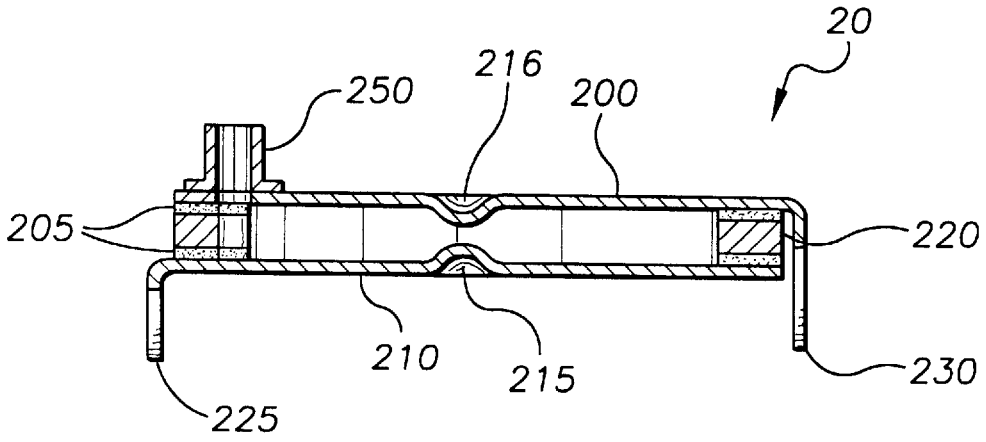
FIG. 6 is a cross-sectional view taken along section line 6 of FIG. 5.
Figure 5:
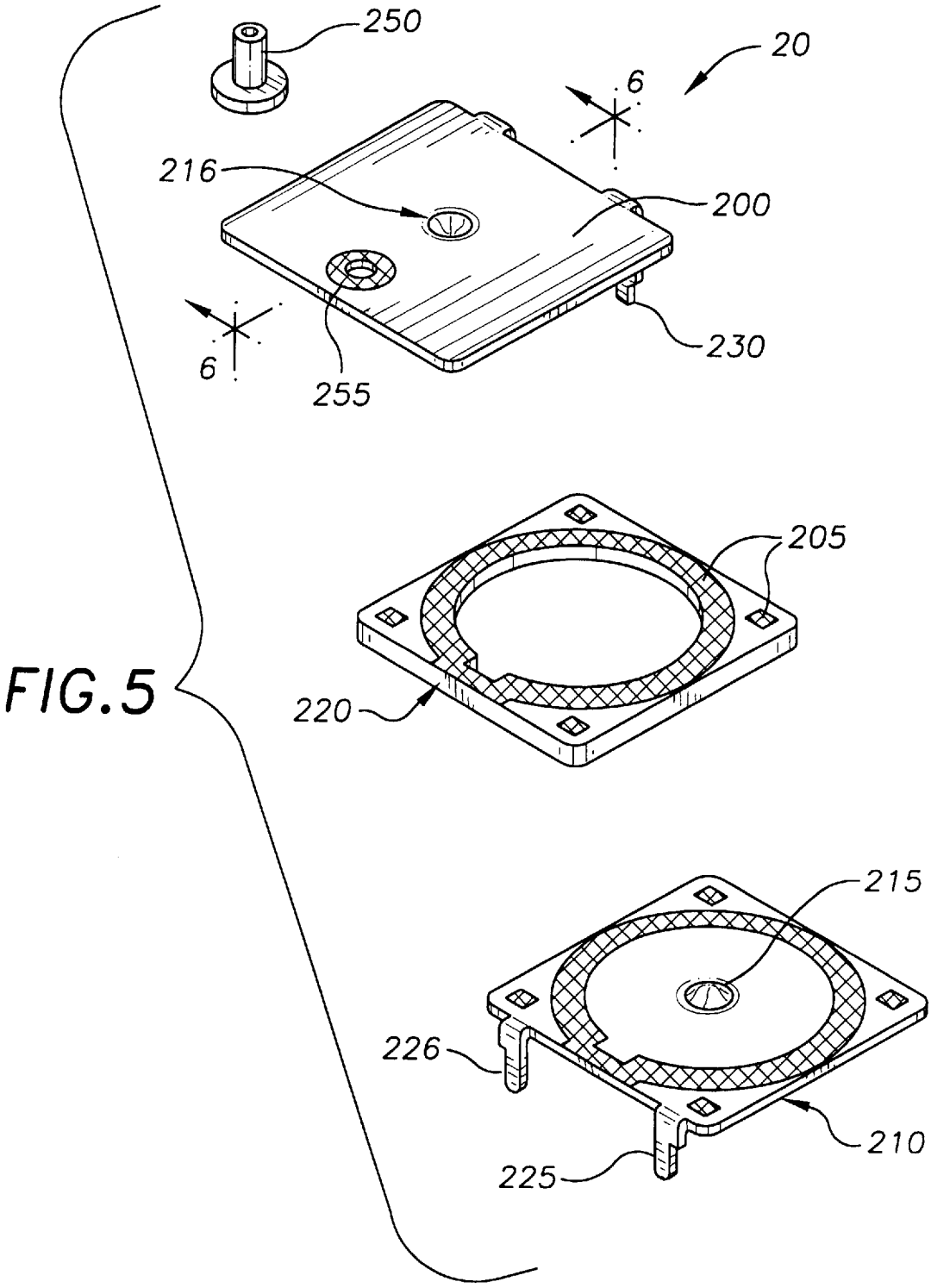
FIG. 5 illustrates a third preferred embodiment of the invention exploded views.

Second and third alternative embodiments of the invention are illustrated in FIGS. 4–6 as switch 20. Switch 20 has been numbered to correspond with the numbering of switch 10, with the hundreds digit changed to 2 instead of 1. For example, diaphragm 210 will be similar in feature to diaphragm 110. For sake of brevity, similar features will be assumed unless otherwise discussed or illustrated.

Switch 20 includes a vacuum port eyelet 250 which may be used after assembly to evacuate the interior of switch 20, or, if desired, back fill switch 20 with a reference gas. FIG. 4 illustrates this eyelet 250 placed off center close to terminal 226, while FIGS. 5 and 6 illustrate an alternative with eyelet 250 placed equidistant between terminals 225 and 226 and closer to spacer 220. The eyelet 250 is placed above a mounting ring 255 covered with braze 105 mounted on diaphragm 200.

VARIATIONS OF THE PREFERRED EMBODIMENTS

While the foregoing details what is felt to be the preferred embodiment of the invention, no material limitations to the scope of the claimed invention are intended.

Further, features and design alternatives that would be obvious to one of ordinary skill in the art are considered incorporated herein. For example, while all of the illustrated embodiments include dimples 115, 116, 215 or 216, one alternative is to form flat, dimple free diaphragms. In this case, the diaphragms would form convex surfaces under conditions where the external pressure is greater than the internal pressure, and when these convex surfaces came into and out of contact, switching would occur. Additionally, a rounded switch could include the vacuum port eyelet, or a square switch could be designed without one. In fact either switch could be designed in any desired shape.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the description. All changes that come within the meaning and range of equivalency of the claims are to be embraced within their scope.

We claim:

1. A pressure switch, comprising:

a) a first and a second electrically conductive diaphragm, disposed generally parallel to each other including:

a1) a first and second dimple integral to the first and second diaphragm, respectively;

a2) a first and second terminal integral with the first and second diaphragm, respectively, each terminal extending perpendicular to each diaphragm, the second terminal extending beyond the first diaphragm;

b) a spacer electrically and mechanically spacing the first diaphragm from the second diaphragm; and c) a braze material having both a filler and activating metal bonding the first and second diaphragms to the spacer such that an external pressure exceeding a first pressure level causes the first and second dimples to come into electrical contact and creates an electrical path between the first and second terminals.

2. The pressure switch of claim 1, wherein the first and second diaphragms are comprised by a metal material, and the spacer is comprised by a ceramic material.

3. The pressure switch of claim 1, further comprising a vacuum port connected to the first diaphragm for modifying the internal pressure of the pressure switch.

4. The pressure switch of claim 1, further comprising a coating of highly conductive metal on contacting surfaces of the diaphragms.

5. The pressure switch of claim 3, wherein the vacuum port is disposed on the first diaphragm and extends away therefrom.

6. The pressure switch of claim 1, wherein the first and second terminal each has a distal and a proxil end, the proxil ends integrally formed with and connected to the first diaphragm, the distal end operable to be connected to an external electrical contact such that the switch has a low overall profile.

7. The pressure switch of claim 1, wherein the external pressure decreasing below the first pressure level causes the first and second dimples to break electrical contact and creates an open electrical path between the first and second terminals.

8. A pressure switch, comprising:

a) a first and second electrically conductive diaphragm disposed generally parallel to each other;

b) a first and second dimple disposed on the first and second diaphragm, respectively;

c) a spacer electrically and mechanically spacing the first diaphragm from the second diaphragm;

d) a first and second terminal integral with the first and second diaphragm respectively and extending perpendicularly therefrom, such that an external pressure exceeding a first pressure level causes the first and second dimples to come into electrical contact and creates an electrical path between the first and second terminals;

e) a vacuum port connected to the first diaphragm and extending perpendicularly away from the first diaphragm, the vacuum port operable to modify the internal pressure within the pressure switch.

9. The pressure switch of claim 8, wherein the first and second diaphragms are comprised by a metal material, and the spacer is comprised by a ceramic material.

10. The pressure switch of claim 8, further comprising a braze material having both a filler and activating metal for bonding the first and second diaphragms to the spacer.

11. The pressure switch of claim 8, further comprising a coating of highly conductive metal on contacting surfaces between the first and second diaphragms.

12. A pressure switch, comprising:

a) a first and second metal diaphragm, disposed parallel to each other and each having both a dimple formed therein and an electrical termination that is integrally formed to extend beyond the periphery of the fist and second diaphragms, each electrical termination disposed perpendicular to the first and second metal diaphragm;

b) a ceramic spacer, interposed between the first and the second diaphragms, for forming an electrical insulation therebetween;

c) a braze material having both a filler and activating metal for bonding the first and second diaphragms to the spacer; and d) a pressure exceeding a first level causes the first and second diaphragms to come into electrical contact.

13. The pressure switch of claim 12, further comprising a vacuum port connected to the first diaphragm for modifying the internal pressure within the pressure switch.

* * * * *